United States Patent [19]

Marsh

[11] 4,112,591

[45] Sep. 12, 1978

[54] HAIR DRYER

[76] Inventor: Charles W. Marsh, 660 Miramar Ave., San Francisco, Calif. 94112

[21] Appl. No.: 579,013

[22] Filed: May 19, 1975

Related U.S. Application Data

[63] Continuation of Ser. No. 480,019, Jun. 17, 1974, abandoned, which is a continuation-in-part of Ser. No. 97,385, Dec. 11, 1970, abandoned, which is a continuation of Ser. No. 858,008, Sep. 15, 1969, abandoned, which is a continuation-in-part of Ser. No. 724,666, Mar. 27, 1968, abandoned, which is a continuation-in-part of Ser. No. 595,693, Nov. 21, 1966, abandoned.

[51] Int. Cl.[2] ..... A45D 20/18

[52] U.S. Cl. ..... 34/99

[58] Field of Search ..... 34/97–101

[56] References Cited

U.S. PATENT DOCUMENTS

| | | | |
|---|---|---|---|
| 2,416,788 | 3/1947 | Andrews | 34/99 |
| 2,437,366 | 3/1948 | Thomas | 34/99 |
| 2,585,735 | 2/1952 | Bunting | 34/99 |
| 3,335,502 | 8/1967 | Butler | 34/99 |

*Primary Examiner*—Carroll B. Dority, Jr.

[57] ABSTRACT

A high speed hair dryer using an oversized pliable perforated hood that collapses about the hairdo on application of suction to the inside of the hood. Drying occurs as the air drawn through the hood perforations passes through the hairdo, enroute to suction tube openings connecting to the inside of the hood. The hood-and-suction-tube structure is pliable enough to conform completely to random irregular configurations of hair-wrapped curlers; every suction tube opening can be positioned onto a hair-wrapped curler, thus precluding loss of suction force in random areas of the hairdo. The speed of drying is such that the dryer uses substantially less electrical energy than that used by conventional dryers.

9 Claims, 7 Drawing Figures

INVENTOR.
CHARLES W. MARSH
BY
Mellin, Moore & Weissenberger
ATTORNEYS

INVENTOR.
CHARLES W. MARSH
BY
Mellin, Moore & Weissenberger
ATTORNEYS

INVENTOR.
CHARLES W. MARSH

BY

Mellin, Moore & Weissenberger
ATTORNEYS

HAIR DRYER

CROSS REFERENCE TO RELATED APPLICATION

This application is a continuation of application Ser. No. 480,019 filed June 17, 1974 and now abandoned. Application Ser. No. 480,019 is a continuation-in-part of my application entitled "Hair Dryer," Ser. No. 97,385, filed Dec. 11, 1970 and now abandoned. Application Ser. No. 97,385 is a continuation of application Ser. No. 858,008 filed Sept. 15, 1969, now abandoned, which is a continuation-in-part of application Ser. No. 724,666 filed Mar. 27, 1968 now abandoned; which is a continuation in-part of application Ser. No. 595,693 filed Nov. 21, 1966 and now abandoned.

BACKGROUND OF THE INVENTION

1. Field of the Invention

The present invention relates generally to the field of hair dryers that operate by suction and more particularly to an improved suction distribution structure therefor.

2. Description of the Prior Art

Many manufacturers of hair dryers have, over a period of many years, introduced various modifications to hair dryers, all aimed at easing the burdsensome task of drying hair. However, there is general agreement that no single conventional hair dryer is completely satisfactory as to speed of operation, comfort and ease of operation. The type of hair dryer most commonly in use in beauty salons constrains the user to maintain an uncomfortably rigid position, causes the user's head to become uncomfortably hot, and dries the hair slowly. Portable hair dryers manufactured especially for home use are relatively comfortable and easy to use, but they dry the hair very slowly.

A number of prior art devices utilize suction force, although to applicant's knowledge no such prior are device has ever proved to be practical. One such prior art device uses multiple flexible suction tubes connecting to a perforated pliable membrane which collapses under suction force, and promotes drying in somewhat the general manner of applicant's device. However the suction-tube-and-membrane of this prior art device mechanically restricts some suction tube holes from contacting the hairdo, for practical hairdos employing random curler placement. The result is incomplete drying of random complex hairdos, as will hereinafter be explained.

SUMMARY OF THE INVENTION

One object of the invention is to provide a hair dryer which vary rapidly dries hair wrapped on curlers, and does so at operating temperatures very comfortable to the user. This and other objects of the invention are achieved by a suction hair dryer using a pliable perforated hood and improved suction distribution means to force drying air through multiple layers of hair wrapped on curlers. A uniquely pliable hood-and-suction-tube structure allows every suction tube opening to be positioned onto a hair-wrapped curler of a random complex hairdo, precluding loss of suction differential at random areas of the hairdo.

The hood is of a tightly woven nylon, the perforations consisting of the interstices of the weave. Extreme closeness of perforation spacing is thus provided, for maximum drying efficiency, in combination with extreme durability of the hood.

DESCRIPTION OF THE PREFERRED EMBODIMENT

Figure 1:
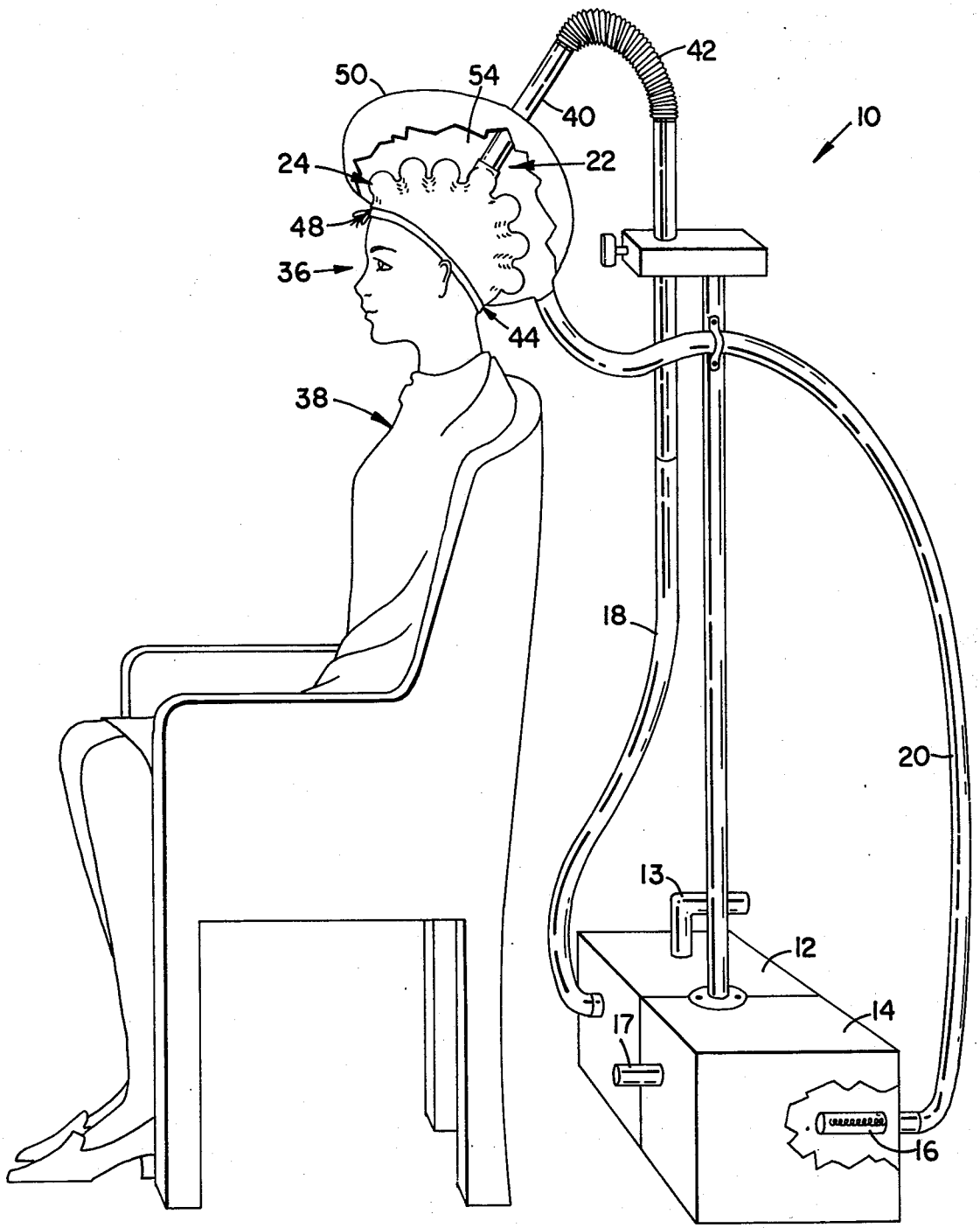
FIG. 1 is a perspective view of the first embodiment of the invention.

FIG. 1 is an overall view of the first embodiment, showing suction distribution means 22, superatmospheric pressure means 14 and a subambient pressure means. The subambient pressure means includes a suction source 12, suction hose 18 and exhaust pipe 13. Suction source 12 consists of a suction pump, enclosed fan or other conventional suction means. Suction hose 18 is supported vertically in a conventional manner as shown and connects to flexible pipe 42 of the suction distribution means 22. The superatmospheric pressure means is a conventional air pump or enclosed fan. Its intake connects to intake pipe 17 and its exhaust connects to supply hose 20. A conventional electric heater element 16 is disposed adjacent the intake end of exhaust hose 20. Exhaust hose 20 connects to pressure bag 50, to supply warmed air at superatmospheric pressure to the interior thereof.

Figure 2:
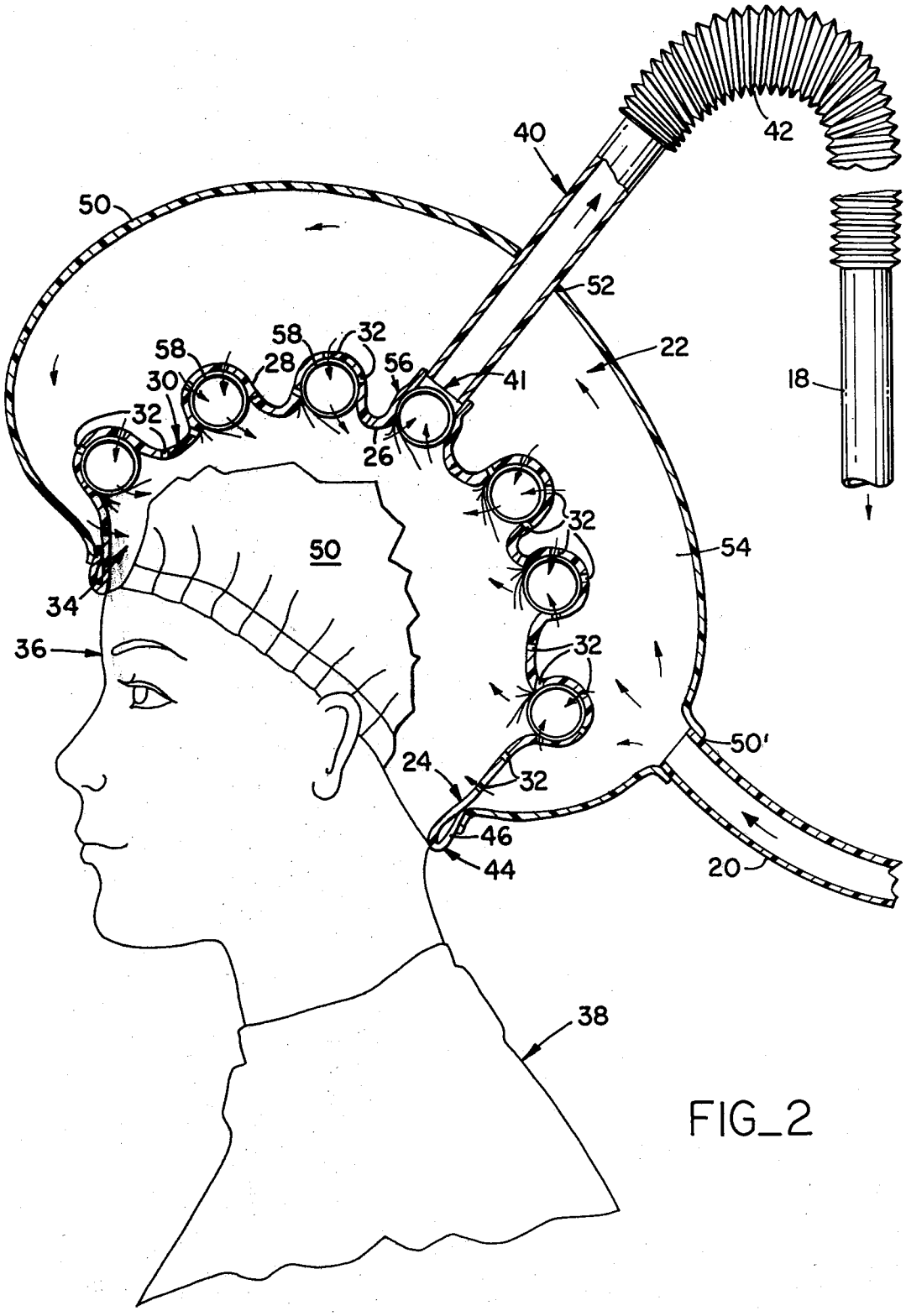
FIG. 2 is a side view, partially broken away and in section, of the hood area of the embodiment shown in FIG. 1.

Suction distribution means 22, as best seen in FIG. 2, includes hood 24, suction conduit 40 and flexible pipe 42. The "conduit means" of the first embodiment comprises suction conduit 40 and flexible pipe 42. The hood, or membrane, is pliable and has an inner hair-engaging surface 26 and an outer surface 28. The hood has a multiplicity of spaced holes, or perforations 32, throughout the hair-engaging area 30. The size and spacing of these perforations are both greatly exaggerated in FIG. 2, for clarity. The holes 32 provide pneumatic communication between the inner and outer surfaces 26, 28 of the hood 24. The hair-engaging area 30 is large enough to cover, envelope and closely conform to the hairdo throughout the total area of a complex hair configuration 34 on the head 36 of the user 38. The term "complex hair configuration" is herein defined as a hairdo configuration consisting of hair-wrapped curlers of random sizes and random positioning.

For clarity, the hood 24 is shown in FIG. 2 as of a pliable plastic material with holes therethrough. The thickness of the hood material as shown is greatly exaggerated, for clarity. The hood is preferably formed of a tightly woven material such as nylon, the interstices of the weave serving as the holes 32. It is to be understood the hood may be of any suitable pliable material with suitable holes therethrough.

The hood includes a peripheral head-gripping portion 44 in the form of an annular shirr tube 46 through which is disposed a pliable fastening band 48 (FIG. 1). Pressure bag 50 is an outer pliable enclosure disposed over the hood 24 and bonded to the hood along the peripheral head-gripping portion 44. Pressure bag 50 includes an aperture 52 through which suction conduit 40 is disposed, suction conduit 40 fitting loosely in aperture 52. The pressure bag thus provides a substantially enclosed region 54, encompassing the outer surface 28 of hood 24, in which superatmospheric pressure can be maintained. The suction conduit 40 passes through the enclosed region 54 and through the aperture 52 to the exterior of the pressure bag.

The air outlet end of suction conduit 40 connects to the intermediate conduit means, flexible pipe 42. The outer end of the intermediate conduit means connects to suction hose 18. The air inlet end of suction conduit 40 connects to the inner hair-engaging surface 26 of the hood, the air inlet end of suction conduit 40 thereby defining an air inlet 41. It should be noted that in the first embodiment the "intermediate conduit means" comprises only flexible pipe 42, whereas in the second embodiment the "intermediate conduit means" comprises flexible pipe 42 and intermediate conduit 72.

As shown in FIG. 2, perforations 32 are not provided in the vicinity of the air inlet 41. (FIG. 7 similarly illustrates this for the second embodiment, in the vicinity of air inlet 82). This absence of perforations 32 is termed a non-perforated membrane area 56, and covers a generally annular hood area encircling air inlet 41. It is to be understood that the pliability of a non-perforated membrane area may be less than the rest of the hood membrane's pliability.

As previously stated, the hood is preferably formed of tightly woven nylon, or similar cloth. The center to center hole spacing, or distance between the centers of adjacent perforations 32, is typically 0.010", for the nylon material used in applicant's working model. The non-perforated membrane area 56, of a nylon hood, is an annular band about ½" wide, encircling the conduit 40. Thus a non-perforated membrane area defines a radically different hole spacing from that of the rest of the hood membrane. The function of this element of the invention will be explained in the operational description.

In operation, the hood 24 is placed over the complex hair configuration 34 of the user 38, with air inlet 41 being positioned directly onto a hair-wrapped curler as shown in FIG. 2. This positioning of air inlet 41 is always possible because the intermediate conduit means, flexible pipe 42, is flexible. Fastening band 48 is tightened and the subambient pressure means is actuated. Superatmospheric pressure means 14 and electric heating element 16 are also actuated. The peripheral head-gripping portion 44 prohibits, or severely limits, the flow of air into the user's hairdo from under the hood's periphery. Also, the total hole area of the perforations 32 is limited enough so airflow through the perforations cannot satisfy the suction applied to the inside of the hood. A strong pressure differential results, between the outer and inner surfaces of the hood, and the hood collapses about the hairdo. The suction force holds suction conduit 40 (and therefore air inlet 41) at the hairdo location at which it was positioned.

The application of superatmospheric pressure to the exterior of the hood enhances the pressure differential but is not essential to the operation of the dryer; without the superatmospheric pressure the hood would still collapse and grip firmly to the hairdo.

The strong suction force applied causes the pliable nylon hood to conform essentially completely to the complex hair configuration, the completeness of conformance being limited only by the pliability of the hood material. Air is drawn along the user's scalp, from the interiors of all curlers, (FIG. 2), to the curler on which the air inlet is positioned, suction thereby drveloping in the interiors of all the curlers. The resulting pressure differential from the exterior of the hood is to the interior of each hair-wrapped curler causes drying air to be pulled through the holes 32 and then to be pulled perpendicularly through the multiple layers of tightly wrapped hiar, to the interiors of the curlers, thus drying the curls. It is this mode of drying that makes possible the extremely short drying times achieved by applicant's device. Curlers of a conventional open mesh construction are used to allow perpendicular airflow through the curlers.

All the holes 32 in the hylon hood of applicant's working model are interstices of the weave. As stated previously, the center to center spacing of these holes is typically 0.010". This extremely close hole spacing allows drying to occur essentially as fast in areas between adjacent holes 32 as at any hole 32. This promotes a maximum rate of overall drying of the hairdo. A particular advantage of using a woven material, such as nylon, is that this extremely close hole spacing can be achieved in a pliable membrane that is extremely strong and durable; a pliable plastic-film membrane with holes 0.010" apart would be much more subject to tearing, especially between adjacent holes, in normal usage.

The maximum pressure differential between the inner and outer surfaces 26, 28 of the hood tends to occur in the vicinity of the air inlet 41; since the suction is supplied via the air inlet, the gradient of suction force decreases in directions going outwardly from the air inlet. By increasing the size of the non-perforated membrane area 56, this condition of maximum pressure differential can be diffused over a larger number of perforations. The combination of the size of the non-perforated membrane area 56, the porosity of the hood 24, and the suction force applied determines how evenly the pressure differential is distributed over the hair engaging area of the hood. Porosity is here defined as the ratio of hole area to unit area. To enhance the uniformity of suction distribution over the hairdo area, the hood porosity may be less in the vicinity of the non-perforated membrane area and greater in the area further from it. Such decreased porosity would counteract the tendency for excessive airflow (through the membrane) immediately adjacent the non-perforated membrane area, as compared to other areas.

Figure 7:
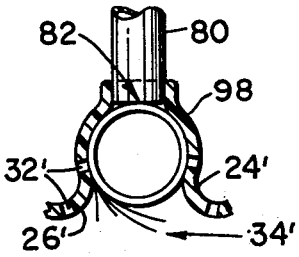
FIG. 7 is a sectional view taken along line 7—7 of FIG. 4.

A very pliable hood conforms essentially completely to the hairdo, but small areas of non-conformance can occur at the air inlet area, as seen in FIGS. 2 and 7. If the hood in these small areas used the normal, typical, hole spacing, substantial suction losses would occur through multiple "short-circuit" paths. A "short-circuit" path is one in which air can flow through a hole 32 and then directly into air inlet 41 without passing through the hairdo. However, the use of a non-perforated membrane area, extending outwardly from the air inlet a distance on the order of ½" in all directions, prevents such "short-circuit" suction losses. The use of extremely close perforation spacing, on the order of 0.010", is made feasible only because of the use of a non-perforated membrane area 56.

Figure 3:
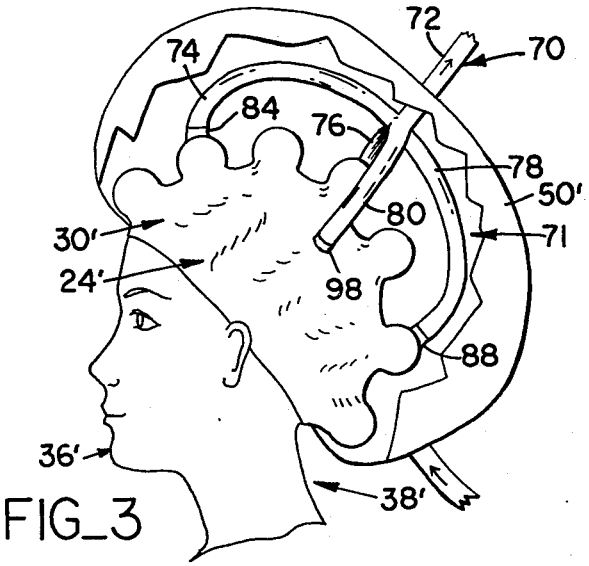
FIG. 3 is a side view, partially broken away, of the hood area of the second embodiment of the invention.

The second embodiment, FIGS. 3 through 7, is the same as the first embodiment except that it uses multiple suction conduits to distribute the suction to the hood. Applicant's working model uses four suction conduits as depicted in FIGS. 3–6, however any suitable number of suction conduits may be used. Referring to FIG. 3, suction is applied to the inside of hood 24' by means of suction conduits 74, 76, 78 and 80, which all connect to intermediate conduit 72. Intermediate conduit 72 connects to flexible pipe 42 (not shown in FIG. 3) in the same manner as does conduit 40 of the first embodiment. In the second embodiment, the "intermediate conduit means" comprises intermediate conduit 72 and flexible pipe 42, and the "conduit means" comprises intermediate conduit 72, flexible pipe 42 and the multiple suction conduits such as 74, 76, 78 and 80.

Figure 4:
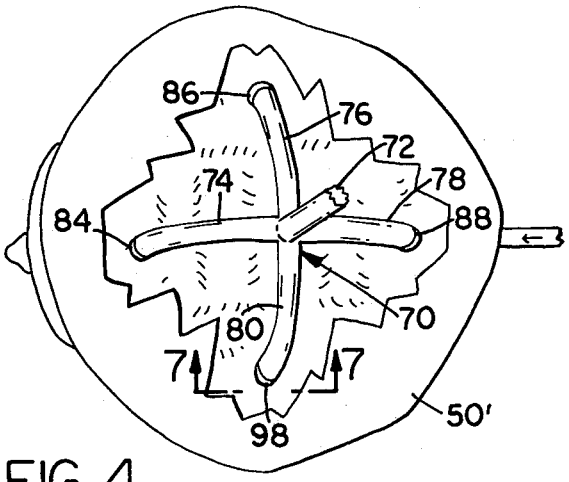
FIG. 4 is a plan view, partially broken away, of the hood area of the embodiment shown in FIG. 3.

Hood 24' has a multiplicity of spaced perforations 32' throughout the hair-engaging area 30'. The size and spacing of these holes is greatly exaggerated in FIG. 7, for clarity. The thickness of the pliable hood membrane 24' in FIG. 7 is also greatly exaggerated, for clarity. The hood 24' is preferably of a tightly woven nylon as in the first embodiment, with similar hole size and spacing. Hood 24' includes a peripheral head-gripping portion (not shown) similar to that of the first embodiment. Each of the suction conduits is generally elongated and terminates where it adjoins the hood 24' in a single opening defining an air inlet 82. The air inlets communicate with the inner hair-engaging surface 26' of the hood. The suction conduits are flexible and are here formed of wire reinforced flexible plastic tubing. Encircling the air inlets 82 are non-perforated membrane areas 84, 86, 88 and 98 (FIG. 4). These are the same in structure and function as the non-perforated membrane area 56 of the first embodiment.

Figure 5:
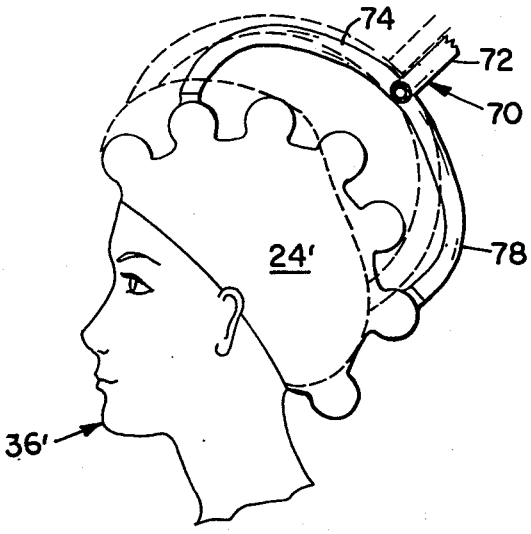
FIG. 5 is a schematic side view of the hood area of the embodiment shown in FIGS. 3 and 4.
Figure 6:
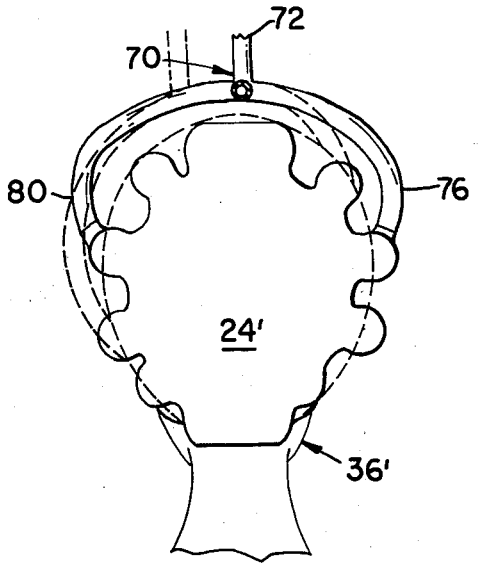
FIG. 6 is a schematic rear elevation of the hood area shown in FIGS. 3 and 4.

In operation, the hood is placed on the user's head and the peripheral fastening band is tightened. All air inlets 82 are positioned directly onto hair-wrapped curlers and the subambient pressure means is actuated, the force of suction then holding the hood and the air inlets in place. The superatmospheric pressure means and the heating element are actuated, supplying warmed air to the enclosure formed by the pressure bag 50'. Drying occurs in the same manner as described for the first embodiment except that there are multiple air inlets, spaced over the hairdo. The suction conduits are flexible independently of each other, so each air inlet can be positioned as needed to contact randomly positioned curlers. This is indicated schematically in FIGS. 5 and 6. The dotted lines schematically indicate possible alternate hairdo configurations and possible alternate positioning of the suction conduits. As indicated in FIGS. 5 and 6, the intermediate conduit 72 can also shift position as needed. This is possible because of the flexibility, in all directions, of flexible pipe 42. Also, each air inlet 82 is a single hole at the end of a tube contacting the hairdo approximately perpendicularly; curlers adjacent the area of contact will not prevent an air inlet from contacting the curler firmly. It should be noted that on application of suction each air inlet grips very firmly to the surface on which it is positioned.

Applicant's configuration of structural elements allows all air inlets 82 to be positioned, at the same time, onto hair-wrapped curlers, for any random complex hair configuration. In a prior art device, some air inlets are mechanically restrained from contacting randomly positioned curlers. This can result in local suction losses and local losses of pressure differential perpendicularly to layers of hair wrapped on curlers, with random "wet spots" resulting. A very strong pressure differential is needed to pull drying air perpendicularly through multiple layers of tightly wrapped hair. A suction dryer must be designed to effectively preclude any such areas of inadequate pressure differential, to be practical for ordinary hair configurations using curlers.

Since the suction conduits 74 – 80 are all substantially the same length, and all join centrally to the intermediate suction means, the suction force available at all air inlets 82 is substantially equal. This enchances uniformity of drying speeds throughout the hairdo area, thus minimizing the overall drying time for a given overall suction power.

For either embodiment, applicant has found it very advantageous to use air inlets 41, 82 which are very large in comparison with the membrane perforations 32, 32'. Very great effectiveness is achieved if the cross-sectional area of each air inlet is at least 50 times as great as the cross-sectional area of each perforation. This promotes strong suction currents, penetrating deeply into the hairdo.

Applicant's working model is a portable, or "table top," version which dries hair in approximately one fourth to one half the time required by conventional dryers, depending on the type of dryer being compared. The rapid drying has an evaporative effect which produces significant cooling in the scalp region, and the user experiences very comfortable temperatures. In fact, if warmed air is not provided, the scalp can become uncomfortably cool. Applicant's device uses approximately 1500 watts of power and dries in less than half the time of most conventional dryers. Therefore the total electrical energy used in substantially less than that of conventional dryers.

While preferred forms and arrangements of parts have been shown in illustrating the invention, it is to be understood that various changes in details and arrangements of parts may be made without departing from the spirit and scope of this disclosure. For example, the suction distribution means, including the hood structure, could be used in conjunction with a conventional domestic vacuum cleaner, either with or without means for providing warmed air.

Having thus described my invention, I claim:

1. Hair drying apparatus comprising: a pliable membrane having an inner hair-engaging surface and an outer surface; said membrane including a multiplicity of spaced perforations dispersed throughout the hair-engaging area of said membrane for communication between said inner and outer surfaces, said hair-engaging area being large enough to closely conform to a complex hair configuration on the user's head; and means for maintaining a pressure differential between said inner and outer surfaces comprising a peripheral head-gripping portion on said membrane, subambient pressure means outside of said membrane, and conduit means for providing communication of the subambient pressure with the inner surface of said membrane, said conduit means including multiple suction conduits, said conduit means communicating with the inner surface of said membrane through air inlet means comprising multiple air inlets, wherein there is sufficient pliability of the combined structure of said membrane and said conduit means to assure that all such air inlets, simultaneously, are positionable onto hair-wrapped curlers of random sizes wherein said hair-wrapped curlers are randomly positioned on the user's head, wherein said multiple suction conduits are flexible and communicate with the inner surface of said membrane, wherein such suction conduits are located away from the periphery of said membrane, and wherein all such suction conduits are joined directly to an intermediate conduit means located in spaced relation to said membrane.

2. Apparatus according to claim 1 wherein each of said suction conduits is generally elongated and terminates at said membrane, thereby defining a single air inlet for each suction conduit.

3. Hair drying apparatus comprising: a pliable membrane having an inner hair-engaging surface and an outer surface; said membrane including a multiplicity of spaced perforations dispersed throughout the hair-engaging area of said membrane for communiction between said inner and outer surfaces, said hair-engaging area being large enough to closely conform to a complex hair configuration on the user's head; and means for maintaining a pressure differential between said inner and outer surfaces comprising a peripheral head-gripping portion on said membrane, subambient pressure means outside of said membrane, and conduit means for providing communication of the subambient pressure with the inner surface of said membrane, said conduit means including intermediate conduit means and a single suction conduit, said suction conduit communicating with the inner surface of said membrane through air inlet means comprising a single air inlet, wherein the improvement comprises: said suction conduit being located away from the periphery of said membrane, said suction conduit joining directly to said intermediate conduit means, said intermediate conduit means being located in spaced relation to said membrane, wherein the combined structure of said suction conduit and said intermediate conduit means is flexible to allow positioning of said air inlet onto a hair-wrapped curler of any random configuration of hair-wrapped curlers on the user's head.

4. Hair drying apparatus comprising: a pliable membrane having an inner hair-engaging surface and an outer surface; said membrane including a multiplicity of spaced perforations dispersed throughout the hair-engaging area of said membrane for communication between said inner and outer surfaces, said hair-engaging area being large enough to closely conform to a complex hair configuration on the user's head; and means for maintaining a pressure differential between said inner and outer surfaces comprising a peripheral head-gripping portion on said membrane, subambient pressure means outside of said membrane, and conduit means for providing communication of the subambient pressure with the inner surface of said membrane, said conduit means comprising intermediate conduit means and multiple suction conduits, said conduit means communicating with the inner surface of said membrane through air inlet means comprising multiple air inlets, wherein all such suction conduits are joined directly to said intermediate conduit means, wherein said intermediate conduit means is located in substantial spaced relationship to the peripheral portion of said hair-engaging area of said membrane.

5. Apparatus according to claim 4 wherein all such suction conduits are located, entirely, in substantial spaced relationship to the peripheral portion of said hair-engaging area of said membrane.

6. Apparatus according to claim 4 wherein each of said suction conduits is generally elongated and terminates at said membrane, so that a single air inlet is defined for each such suction conduit.

7. Apparatus according to claim 4 wherein each of said suction conduits terminates at said membrane in a substantially transverse opening.

8. Apparatus according to claim 4 wherein all such suction conduits are located, entirely, in sustantial spaced relationship to the peripheral portion of said hair-engaging area, and wherein each of said suction conduits is generally elongated and terminates at said membrane, so that a single air inlet is defined for each such suction conduit.

9. Apparatus according to claim 4 wherein a non-perforated membrane area encircles each air inlet such that the distance, measured along the membrane surface, from any peripheral point of each such air inlet to the nearest perforation is at least 10 times as great as each and every center to center distance, measured along the membrane surface, between adjacent perforations.

* * * * *